United States Patent [19]

Reichenberger

[11] 3,993,218

[45] Nov. 23, 1976

[54] LIQUOR DISPENSER

[76] Inventor: Arthur M. Reichenberger, 1916 N. 21st Place, Phoenix, Ariz. 85006

[22] Filed: Mar. 7, 1975

[21] Appl. No.: 556,498

[52] U.S. Cl. ..... 222/30; 222/129.4; 222/144.5

[51] Int. Cl.[2] ..... B67D 5/56

[58] Field of Search ..... 222/30, 61, 76, 129.4, 222/504, 144.5; 285/338

[56] References Cited

UNITED STATES PATENTS

| | | | |
|---|---|---|---|
| 775,124 | 11/1904 | Christman | 285/338 X |
| 1,460,208 | 6/1923 | Mohn | 285/338 X |
| 3,112,844 | 12/1963 | Keller et al. | 222/61 |
| 3,221,936 | 12/1965 | Spinuzza | 222/61 X |
| 3,241,720 | 3/1966 | Barney | 222/144.5 X |
| 3,768,839 | 10/1973 | Thompson | 285/338 |
| 3,802,606 | 4/1974 | Gust | 222/504 |

*Primary Examiner*—Allen N. Knowles
*Assistant Examiner*—Hadd Lane

[57] ABSTRACT

A liquor dispenser adapted for use in connection with bottles of liquor or other beverages. The dispenser includes a bottle cap and spout and a cooperative electromagnet adapted to magnetically open a valve in the said spout upon the operation of a switch which energizes the electromagnet. Further, the disclosure relates to a guide on the electromagnet for conductive pneumatic fluid pressure into a bottle in which the cap and spout are sealingly engaged when the cap and spout is shouldered in the guide adjacent to the electromagnet, the cap being provided with a converging shoulder adapted to be pressed into a converging shoulder in the guide and a pair of annular gaskets are spaced apart on the shoulder of the cap for sealingly engaging the guide at opposite sides of a conduit which communicates between the gaskets and delivers compressed pneumatic fluid into a passage in the cap which communicates with the interior of a bottle in which the cap is disposed. The disclosure also relating to securing the cap in sealed relation to the neck of a bottle. The dispenser further includes an electromagnetic valve and relay in circuit with a switch whereby when the switch is operated, a time delay relay operates a magnetic valve for conducting compressed pneumatic fluid under constant pressure through the conduit and passage, between the pair of gaskets and into said bottle to build up sufficient pressure therein to a predetermined level before said electromagnetic is energized to operate a magnetically responsive operator in the spout of the cap whereby dispensation through a control passage provides for the flow of liquor at a constant rate for a constant period of time during which the time delay relay maintains the electromagnet and said magnetic valve energized.

16 Claims, 10 Drawing Figures

LIQUOR DISPENSER

BACKGROUND OF THE INVENTION

Various systems and devices have been known in the prior art for the purpose of recording and counting the various and aggregate dispensations of liquors by barkeepers in various establishments so as to accurately monitor the amount of liquors and drinks being dispensed by the bartender in relation to the receipts or monies collected for such drinks or dispensations of liquor at the bar. Examples of the prior art are contained in the following patents and their prosecution file wrappers. These U.S. Pat. Nos. are 3,170,597 issued Feb. 23, 1965; 3,599,833 issued Aug. 17, 1971; and 3,688,947 issued Sep. 5, 1972.

The above identified patents were issued to the applicant Arthur M. Reichenberger who is the inventor of the subject matter of this application.

Various prior art devices have been utilized for dispensing liquor from a plurality of liquor bottles of different brands by utilizing a common means for actuating a dispensation from any one of a plurality of bottles containing various brands of liquor. In many of the prior art devices, there have been difficulties in manual actuation of the various bottles in relation to the common dispenser means which has caused a loss of time and further many of the devices have had difficulty in maintaining accurate volumetric dispensation of drinks such that each dispensation very accurately approximates a jigger or a multiple thereof as desired. Furthermore, many of the prior art devices have been unattractive to customers since they have not simulated conventional pouring devices or pouring methods and thereby causing the customers to be concerned as to the actual dispensation of the desired liquors.

Many of the prior art devices were not operable in a natural pouring attitude normally assumed by the bartender when he merely tilts the desired bottle over a glass for pouring a jigger or two of liquior into such glass thus causing a loss of bartender's time. Additionally, other pouring spouts or jigger measuring devices used in connection with bottles have been relatively bulky, expensive and are difficult to maintain in the proper operating condition.

SUMMARY OF THE INVENTION

The present invention relates to a liquor dispenser and counting apparatus particularly for use in liquor bars to insure counting of the various drinks poured and to maintain an inventory so that a careful record may be made of the drinks poured and of the relative monies received for such drinks.

The invention comprises a novel combination of a botle cap and spout means having a magnetically responsive valve therein which is operable by inserting the spout into an electromagnetic means which actuates the valve in the spout and dispenses liquor. Thus a great plurality of liquor bottles may be equipped with one each of said cap and spout devices and each spout may be placed in the common electromagnetic means for actuating the magnetically responsive valve therein and dispensing liquor from the respective bottles.

The cap and spout have gasket means adapted to fit into a guide and seat means adjacent to the electromagnetic means and conduit and passage means conducts pneumatic fluid under pressure into said cap and through a passage therein and into the respective bottle for pressurizing the liquor therein.

A support carrying the electromagnetic means is spring loaded against movement in one direction and the cap and spout mechanism when inserted in the ellectromagnetic means is seated in a guide and seat means such that the aforementioned gaskets make a seal relative to the conduit and passage means which conducts pneumatic fluid under pressure into the bottle and when the support is forced in a direction against its spring loaded direction the gaskets on the cap are forced to seat in the guide and seat means connected with the electromagnetic means and with such movement against the spring loaded support means causes a switch to be actuated which energizes time delay relay and an electromagnetic valve means which admits pneumatic fluid under pressure through said conduit and passage means and into said bottle and whereupon the time delay relay actuates the electromagnetic means for opening the magnetically responsive valve in said spout after sufficient pneumatic pressure has built up in the bottle so as to dispense liquid through said cap and spout at a given rate in accordance with orifice means in the cap and spout such that a predetermined amount of time is measured by said time delay relay and a constant pressure is maintained in said bottles so that liquor passing through said aforementioned passage causes a predetermined amount or volume of liquor to be dispensed in said predetermined amount of time allowed by said time delay relay between the time when said electromagnetic valve means is actuated and the time when said electromagnetic means is actuated to operate said magnetically responsive valve in said spout of said cap on said bottle.

The invention contemplates having a great plurality of bottles containing a great variety of liquors each equipped with one of the cap and spout means in which the magnetically responsive valve mechanism is disposed and a movable support carrying the electomagnetic means which operates the magnetically responsive valve in the spout and whereby pressure of the related cap and spout against gasket means in a related movable support means causes the gaskets to seal or conducting pneumatic fluid under pressure into said bottle and concurrently disposes said spout in a position so that the magnetically responsive valve therein may be subsequently operated by electromagnetic means after sufficient fluid pressure has been built up in each respective bottle as it is individually inserted in the movable support.

The movable support carries the electromagnetic means which is generally a ring-shaped or circular shaped magnetic coil device with a central opening in which the spout of each cap may be inserted for operating the magnetically responsive valve which is reciprocally mounted therein and spring loaded closed and whereby the electromagnetic means when energized forces the valve open against its closing spring.

The cap and spout mechanism is virtually tamper proof without a proper magnetic actuating means since there is no external means by which the valve may be opened.

The movable support means is pivotally mounted on a generally horizontal axis and is swingable from a position in which the support requires the spout and cap to enter at a substantially horizontal position and whereupon the pressure of the cap in the support moves the swing arm laterally and downwardly into an angular position in which the spout is directed downwardly and the axis of the magnetically responsive means in the support is also directed downward whereby the spout dispenses liquor downwardly into a glass or other container on a bar top structure. The swing arm is provided with a stop means and actuates a mercury switch when the swing arm approaches the stop means in position to pour a drink from the magnetically responsive valve of the invention and into a respective glass or container. In circuit with the aforementioned mercury switch is circuitry containing a plurality of time delay relay devices together with digital counting means adapted to display numbers indicating the number of various drinks poured in response to the operation of said mercury switch as said swing arm is tilted from a generally upright position to a relatively downward angular position. A source of regulated pneumatic fluid under pressure is provided to supply the solenoid operated valve so that it may in response to said mercury switch conduct pressure under fluid through said conduit and passage means in said support and a respective bottle from which a drink is to be poured.

Additional means is provided for dispensing drinks from several containers of popular brands from an area of the bar commonly known as the well and a plurality of switches on the aforementioned swing arm are disposed to selectively cause dispensation from any one of said plurality of bottles in the well area of the bar and separate spouts on said swing arm are disposed in the same direction as a spout which may be contained on the respective bottle from a back bar position when the magnetically responsive valve therein is actuated by said electromagnetic means for dispensing liquor into a glass. The spouts for dispensing the liquors from the containers in the well area of the bar thus dispense into a common area and the operator of the apparatus of the invention is thus able readily to selectively choose between liquors in bottles from the back bar which are equipped with the cap and spout means hereinbefore described or from the well as desired.

An interlock switch on the swing arm and the movable support member is engageable by a respective cap and spout means of a bottle from the back bar so as to de-energize circuitry couples to the means for dispensing liquors from the well and to energize the circuitry related to the dispensation of liquors from the back bar. The aforementioned circuitry includes an electrical circuit for counting drinks poured from the back bar through the cap and spout means hereinbefore described in connection with various and numerous bottles on the back bar and also electrical circuitry for controlling and counting drinks poured from the various standard brands in the well area of the bar.

The invention also relates to a novel means for sealingly making a connection of bottle cap and spout or closure relative to the interior of a bottle neck which may contain various liquors or beverages.

Accordingly, it is an object of the present invention to provide a liquor dispenser which contains very compact cap and spout means for liquor containing bottles in the back bar area of a bar and which appear to be conventional pouring spouts but which are each and individually operable in connection with an electromagnetic means which actuate a valve in the spout of each cap and spout means for dispensing liquor therethrough.

Another object of the invention is to provide a novel combination of a bottle cap and spout having a magnetically responsive valve therein and also capable of receiving pneumatic fluid therethrough for pressurizing the interior of a respective bottle so that constant pressure in the bottle forces liquor outward through the magnetically responsive valve when actuated and the liquor passes through a passage or orifice having a fixed cross sectional are so that a time delay relay controlling the operation of the electromagnetic means holds said magnetically responsive valve open for predetermined period of time during which constant pressure in the bottle causes a predetermined volume of liquor to be dispensed through the restricted orifice in the cap and spout means.

Another object of the invention is to provide a liquor dispenser having a movable support means which is spring loaded such that any one of a plurality of bottles having a cap and spout means may be inserted in the support means for dispensation of liquor by an electromagnetic means acting on a magnetically responsive valve in the spout and whereby positioning of the spout in the support and in the area of the electromagnetic means comprises a normal pouring motion where the bottle is gradually tilted from a horizontal position to an inclined position in which liquor is dispensed downwardly into a glass on the bar top whereby the motion is fast and natural to a bartender and thus the dispenser and counting apparatus of the invention does not waste the bartender's time.

Another object of the invention is to provide a liquor dispenser and counting apparatus which readily and easily provides the bartender with means by which liquors can e dispensed both from the back bar and from the well and whereby such liquors are inventoried and each drink thereof is counted as the dispensation occurs.

Another object of the invention is to provide a novel means by which a cap or closure may be sealingly coupled to the interior of a botle neck.

Further objects and advantages of the invention may be apparent from the following specification, appended claims and accompanying drawings.

BRIEF DESCRIPTION OF THE DRAWINGS

FIG. 5 being taken on substantially the same plane as FIG. 2 and showing the structure of the cap and valve on an enlarged scale;

DESCRIPTION OF THE PREFERRED EMBODIMENTS

Figure 1:
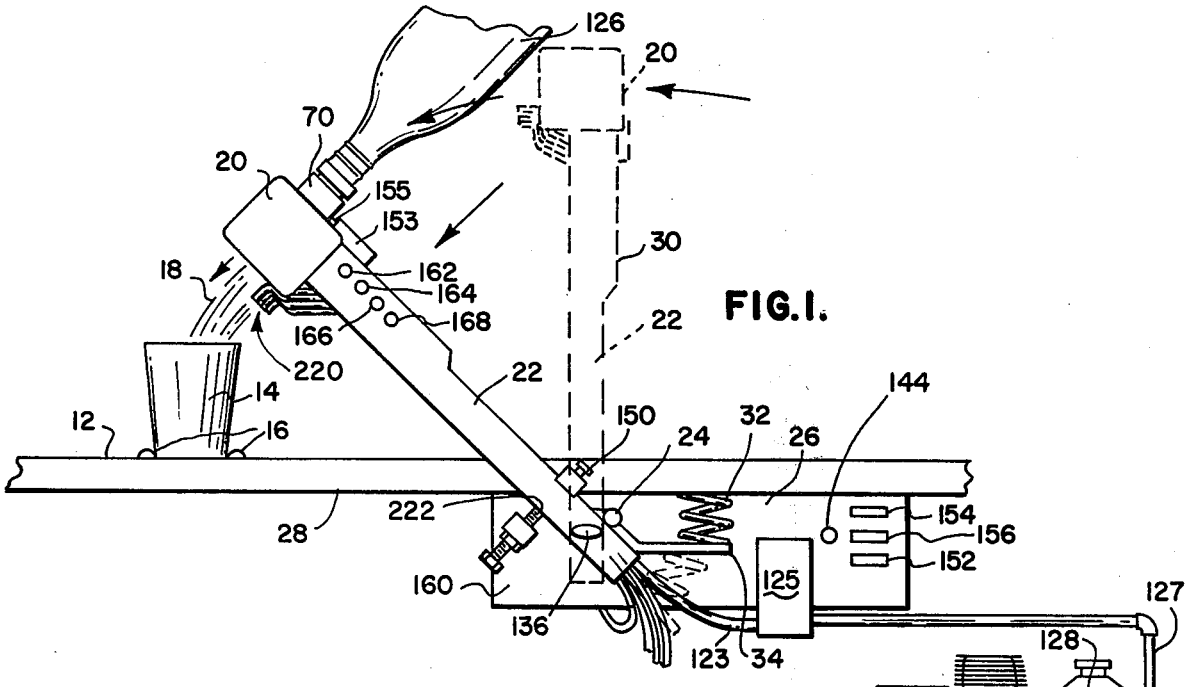
FIG. 1 is a fragmentary side elevational view of a liquor dispenser and counting apparatus of the invention showing by broken lines varying positions of the swing arm and movable support means thereof.

As shown in FIG. 1 of the drawings, a conventional bar top 12 is disposed to support a liquor drinking glass 14 and an annular projection means 16 is located on the bar top 12 for positioning the glass 14 for receiving liquor as indicated by broken lines 18 which may be dispensed from the dispensing apparatus of the invention.

The invention comprises a movable support 20 carried by a swing arm 22 which is pivoted on an axis pin 24 in connection with frame structure 26 coupled to a lower side 28 of the bar top 12.

The swing arm 22 is adapted to move to a broken line position 30 when not in use and a spring 32 acting on a lever 34 fixed to the swing arm 22 is a compression spring and tends to extend for facing the swing arm 22 to pivot to the broken line position 30 thus the spring tends to hold the swing arm 22 in the broken line position 30.

Figure 2:
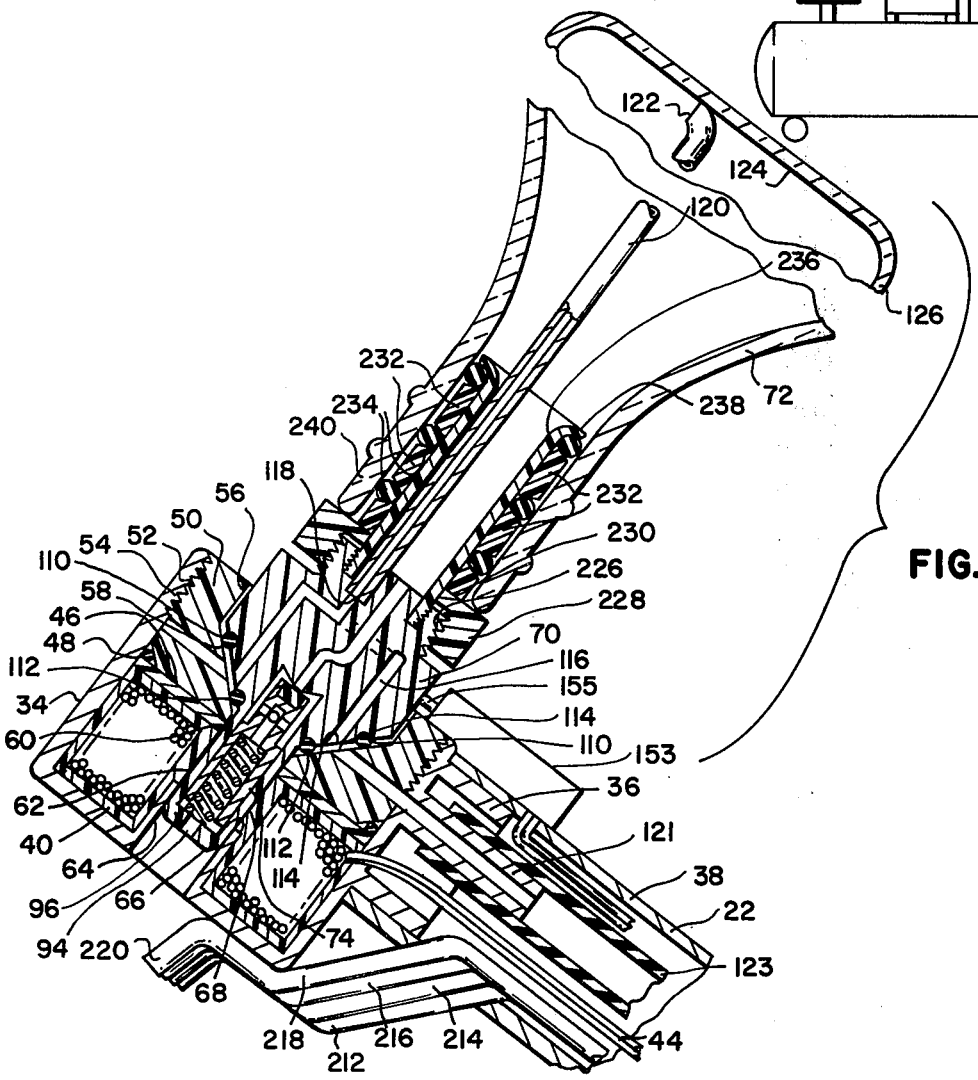
FIG. 2 is an enlarged fragmentary view taken through a portion of the swing arm and the movable support together with ellectromagnetic means carried thereby.

The movable support 20 carried by the swing arm 22 comprises structure as shown best in FIG. 2 of the drawings wherein a cylindrical electromagnet housing 34 is provided with a cylindrical extension 36 fitted into a tubular structure 38 of the swing arm 22.

The magnet housing 34 encloses a spool 40 in which is mounted a magnetic coil 42 having electrical conductors 44 in connection therewith and extending through the hollow tubular structure 38 of the swing arm 22.

Adjacent to the spool 40 is a steel washer 46, adjacent to which an O-ring seal 48 is disposed. The O-ring seal is engaged by a plastic guide means 50 which is provided with external screw threads 52 engaging respective internal screw threads 54 of the housing 34. The guide means 50 is provided with a generally cylindrical bore portion 56 which extends into a generally converging frustoconical bore portion 58. This frustoconical bore portion 58 terminates in conjunction with a central opening 60 of the washer 46 and is substantially conforming with and concentric to a bore 62 of the spool 40.

A hollow cylindrical portion of the housing 34 is designated 64. This hollow cylindrical portion 64 is substantially concentric with and conforming to the internal diameter of the bore 62 of the spool 40 and the housing 34 and portion 64 are made of steel. The portion 64 extending to an area 66 which overlaps a spout 68 which extends from a cap 70 in connection with a bottle 72 which may be any one of several from the back bar of a conventional liquor bar.

The cap 70 and spout 68 are made of plastic and the spout 68 is provided with a magnetically responsive valve 74 reciprocally mounted therein.

Figure 5:
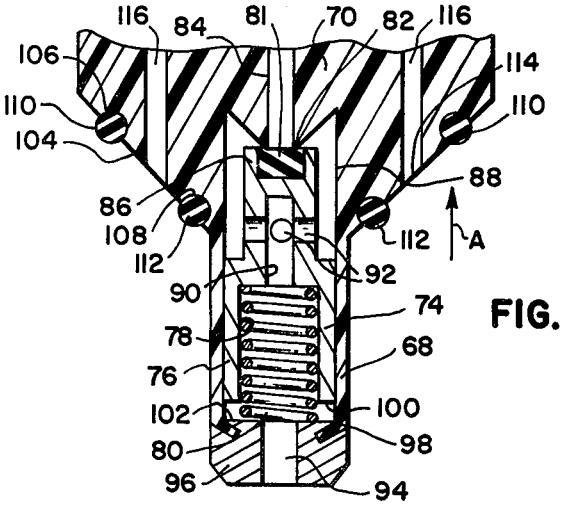
FIG. 5 is an enlarged fragmentary sectional view of a portion of a cap and spout means of the invention.

Reference is made to FIG. 5 showing the valve structure on an enlarged scale for further descripion thereof.

The spout 68 of the cap 70 is a hollow tubular extension of the cap 70 as shown in FIG. 5 and reciprocally mounted there is the magnetically responsive valve member 74 which is preferably made of steel. This valve 74 is provided with a hollow skirt 76 having a bore 78 in which a coil spring 80 is disposed. This coil spring 80 tends to force the valve 74 in the direction of an arrow A so as to close a gasket 81 carried by the valve 74 against a sharp annular seat 82 in the cap portion 70. The seat 82 surrounding the open end of a dispensing passage 84 in the cap portion 70. The gasket 80 is carried in a cup shaped portion 86 of the magnetically responsive valve member 74 and the cap portion 70 is provided with an enlarged bore 88 surrounding the cup shaped portion 86 and a dispenser bore 90 in the valve member 74 communicates with the interior of the bore 78. This passage 90 is provided with a plurality of side ports 92 extending radially therethrough and intercommunicating between the bore 88 of the cap portion 70 and the bore 90 of the valve member such that when the gasket 81 is pulled off the seat 82 liquor may flow through the passage 88 and ports 92 and outwardly through the passage 90 and through the center of the coil spring 80 and outwardly through an orifice 94 in an anvil member 96 fixed to an end portion 98 of the spout 68.

The anvil 96 is made of non-corrosive steel and is thus capable of responding to the electromagnetic force created by the coil 42 so as to assist in actuating the valve member 74 against compression of the spring 80 to open the gasket 81 relative to the seat 82 and to allow liquor to be dispensed through the valve and outwardly through the opening 94 and the anvil 96 all as indicated by broken lines 18 in FIG. 1 of the drawings.

It will be seen that the valve member 74 is provided with an end portion 100 spaced slightly from the inner end 102 of the anvil 96 to form a stop for the valve member as it is magnetically attracted in a direction opposite to the arrow A for opening it during dispensation of liquor therethrough, as will be hereinafter described.

The cap portion 70 is provided with a frustoconical converging portion 104 which converges toward the spout 68 and this frustoconical portion is provided with peripheral grooves 106 and 108 in which respective O-rings 110 and 112 are disposed. The O-rings at the peripheral portions extend beyond the frustoconical surface 104 and are engageable with the frustoconical converging surface 58 in the guide means 50. These O-rings 110 and 112 straddle open ends 114 of passages 116 which extend upwardly through the cap portion 70 and communicate with a common passage 118 which communicates with a tube 120 having an open end 122 which is disposed adjacent the normally lower inside 124 of a liquor bottle 126 which is coupled to the cap 70 as will be hereinafter described.

The open ends 114 of the passages 116 are sealed between the O-rings 110 and 112 and a conduit passage 118 extends through the guide means 50 in communication between the gaskets 110 and 112 to thereby conduct fluid under pressure into the open end 114 of the passages 116.

The conduit passage means 118 is a passage in the guide means 50 which communicates with a hollow tubular portion of the electromagnetic housing 34. The hollow tubular portion 121 is connected to a tubular conduit means 123 which extends through the swing arm 22 and communicates with an electromagnetic valve 125 which receives pneumatic fluid under pressure through a pipe 127 which communicates with a pressure regulator 128. This pressure regulator delivers pneumatic fluid under pressure at a constant pressure to the pipe 127 and the pressure regulator 128 communicates with a pneumatic fluid containing tank 130 which is supplied compressed air or other pneumatic fluid by means by a compressor 134.

A mercury switch 136 mounted on the swing arm 22 is actuated when the swing arm is in the solid line position shown in FIG. 1 and the mercury switch 136 is in open position when the swing arm 22 is in the broken line position 30 as shown in FIG. 1.

When a bottle 126 from the back bar is selected and the spout 68 is inserted through the guide means 50 and into the movable holder 20 the insertion initially takes place with the swing arm 22 in the broken line position 30 as shown in FIG. 1 and the bottle 126 is forced to the solid line position shown in FIG. 1 against compression of the spring 32 thus causing the gaskets 110 and 112 to effect the seal herinbefore described so that compressed air may pass through the passage 119 and into the passage 116 for pressurizing the interior of the bottle 126.

When the swing arm 22 reaches the approximate solid line position shown in FIG. 1 the mercury switch 136 is closed which energizes a relay 138 which opens the solenoid valve 125 admitting compressed air under regulated pressure into the bottle 126 as hereinbefore described. With the closing of the switch 136 the timer 138 is energized and when the timer 138 cycles dispensation is recorded on a counter 154 or a counter 156 depending upon the position of a switch 144 appropriate thereto; also a timer 146 or a timer 148 is started depending upon the position of the switch 144. When the timer 146 or the timer 148 closes and latches it breaks circuit continuity to everything but itself.

After the bottle 126 has reached the solid line position and the foregoing electrical functions occur the bottle is first pressurized by pneumatic fluid therein as hereinbefore described and after a short delay by the time delay relay 138, the dispenser coil 42 is energized through the timer 146 or 148 and the valve member 74 in the spout 68 is opened to dispense contents from the bottle 126 as indicated by broken lines 18 in FIG. 1 of the drawings. After a preset time delay either the timer 146 or 148 breaks the circuit to the master switch 136 thus turning off the energy to the dispenser coil 42 and the three way solenoid valve 125 and in this manner the three way solenoid valve 125 allows the previously built up pneumatic pressure in the bottle 126 to excape in the reverse direction through the tube 120, passages 116, conduit portion 114, tube 123 and the valve 125. With each dispensation, a counter 154 or 156 records dispensation of liquor depending upon which of the various preset timers is used in accordance with a manually operable selection switch 144 which may comprise an automatic latching relay, is operated by the operator on the bar depending upon the quantity of liquor being dispensed.

A pressure switch 150 carried by the swing arm 22 communicates with the tube 123 at the outlet of the solenoid valve 125 and this switch 150 when it senses a reduction in pressure due to the exhaustion of fluids or liquid from the bottle 126 energizes a counter 152 to indicate that the bottle has been emptied and has allowed pneumatic pressure to drop due to a leakage of pneumatic pressure outwardly in lieu of liquid. Thus the counter 152 is pulsed to indicate the number of bottles emptied. The digital display counters 152, 154 and 156 are as shown in FIG. 1 of the drawings and mounted on a housing 160 which contains the circuitry shown in FIG. 7 as will be hereinafter described in detail.

Figure 7:
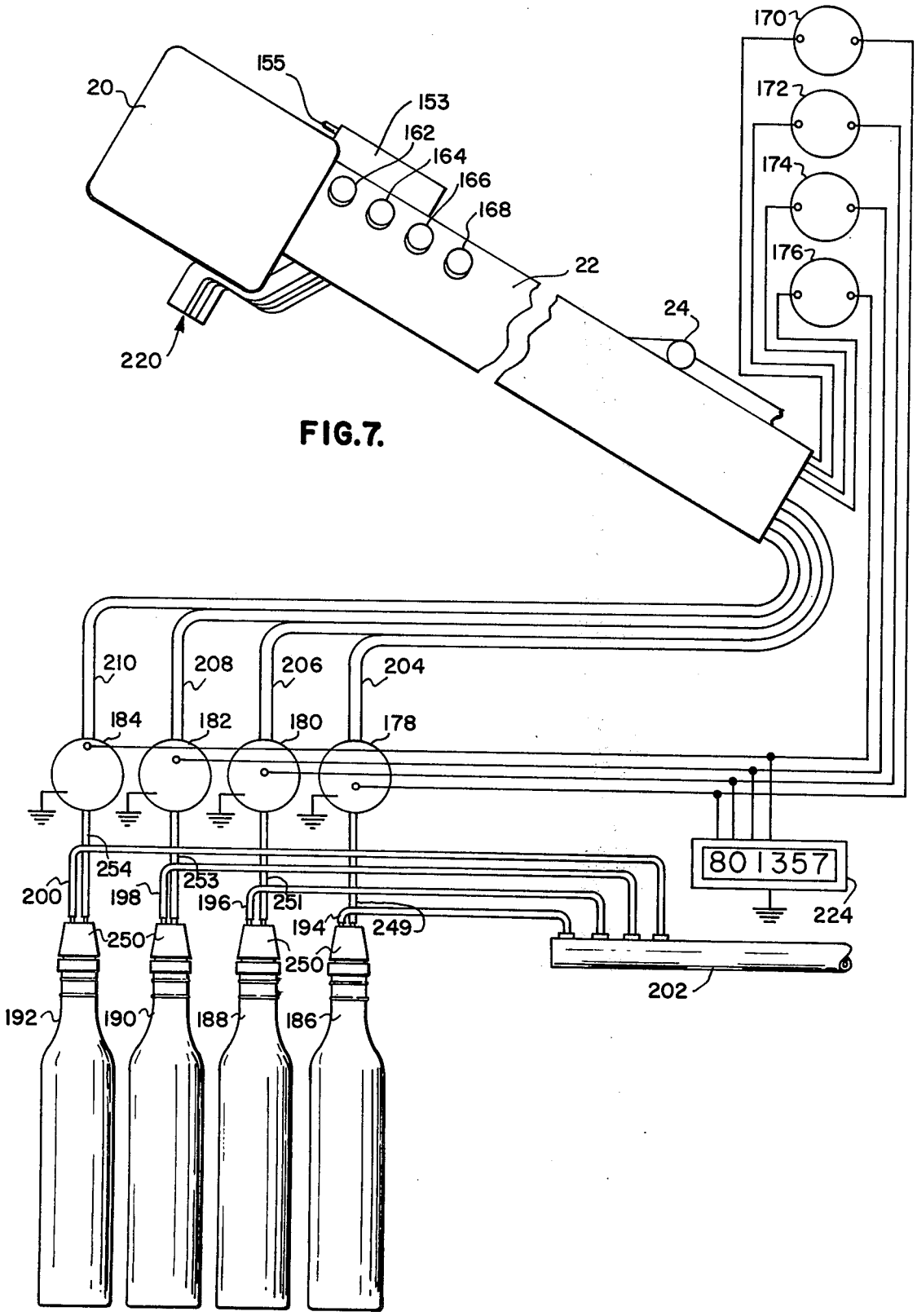
FIG. 7 is a diagrammatic view of circuitry and means for dispensing liquors from any one of a plurality of bottles contained in an area commonly known as well of a bar.

As shown in FIGS. 1 and 7 the swing arm 22 carries a plurality of switches 162, 164, 166 and 168 which are operable to energize respective timers 170, 172, 174 and 176 which are adapted to control respective solenoid valves 178, 180, 182 and 184 coupled respectively to liquor bottles 186, 188, 190 and 192 commonly known as the well in a conventional bar.

Pneumatic fluid pressure conducting tubes 194, 196, 198 and 200 are adapted to conduct pneumatic fluid under pressure into the respective bottles 186, 188, 190 and 192 and these tubes 194, 196, 198 and 200 are coupled to a tubular pressure conduit 202 shown in FIG. 1 of the drawings, this tube 202 receiving pneumatic fluid under regulated pressure from the regulator 128.

Figure 4:
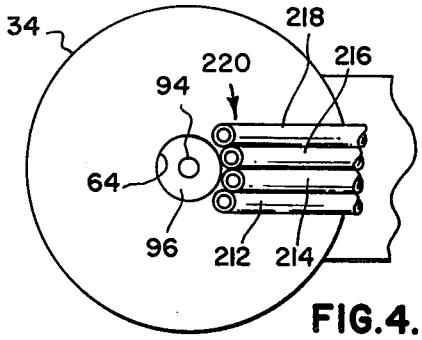
FIG. 4 is a fragmentary view taken from the line 4—4 of FIG. 2 showing the outlet of the dispenser means of the invention.

Coupled to the outlets of the solenoid valves 178, 180, 182 and 184 are respective tubes 204, 206, 208 and 210. These tubes 204, 206, 208, 210 are coupled respectively to liquor outlet nozzles 212, 214, 216 and 218 as shown in FIGS. 2 and 4 of the drawings. These tubes 212, 214, 216 and 218 terminate in respective nozzles generally designated 220 which are directed downwardly at an angle adjacent to the outlet of the spout 68 all as indicated in FIGS. 1, 2 and 4 of the drawings. Thus the spouts 220 direct liquor into the glas 14 as hereinbefore described.

As shown in FIG. 1 it will be seen that the swing arm 22 is provided with an adjustable stop 222 which stops the swing arm 22 in the solid line position as shown in FIG. 1 wherein the mercury switch 136 closes to energize the circuitry as hereinbefore described.

As shown in FIG. 7 a counter 224, or a plurality thereof may be disposed to count the number of drinks dispensed from the well and is coupled to the various relays 170, 172, 174 and 176 and the respective solenoid valves 178, 180, 182 and 184 for recording drinks dispensed from the respective bottles 186, 188, 190 and 192.

As shown in FIGS. 1 and 7, lockout switch 153 is provided with a plunger 155 engageable by the cap 70 when inserted in the bore 56 shown in FIG. 2 of the drawings. Thus the switch 153 is operated each time a bottle 126 and its pouring spout 68 is inserted in the movable holder 20. This switch 153 is normally open to the circuit as shown in FIG. 6 and is closed to operate the circuit shown in FIG. 6 when the bottle 126 is inserted and the switch 153 is activated.

Figure 6:
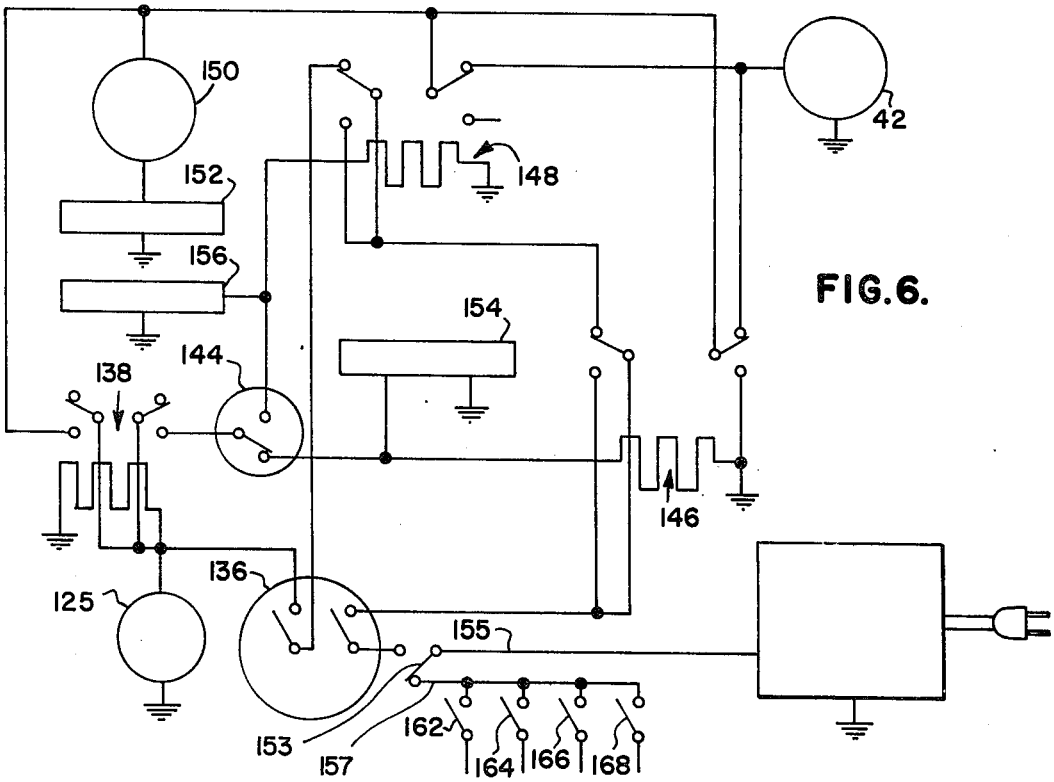
FIG. 6 is a diagrammatic view of the electrical circuitry utilized in connection with the dispensation of liquors from the back bar and in relation to the cap and spout means shown in FIGS. 2 to 5 inclusive of the drawings.

When the bottle is removed, the switch 153 closes to a conductor 157 shown in FIG. 6 to energize the circuit shown in FIG. 7 of the drawings so that liquor may be dispensed from the well in connection with the swing arm 22 and the dispenser spouts 220 as shown in FIG. 1 of the drawings.

Figure 3:
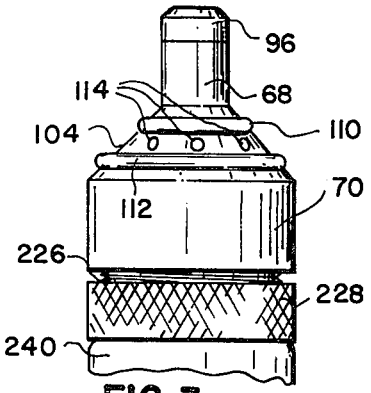
FIG. 3 is a fragmentary side elevational view of a portion of a bottle neck with the bottle cap and spout means of the invention secured in connection therewith.

As shown in FIGS. 2, 3, 8, 9 and 10 bottle necks and the closure and seal means are disclosed. These seal means connect the cap and spout structures as shown in FIGS. 2 and 3 as well as the cap structure shown in FIGS. 7 and 8.

As shown in FIG. 2, the cap 70 is provided with an external screw threaded portion 226 engaging a respective internal screw threaded portion of a nut 228 which is provided with an inwardly directed 230 bearing on one of a series of wedge blocks 232 between which ultimate O-rings 234 are disposed. The wedge members 232 are alternately disposed between the O-rings 234 as shown best in detail in FIG. 10 of the drawings.

Figure 9:
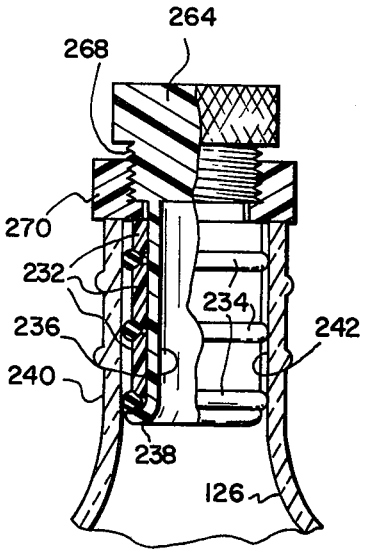
FIG. 9 is an axial sectional view of a bottle neck showing a modification of the invention in connection therewith, namely, a cap and closure means employing novel closure seal means in connection therewith.
Figure 10:
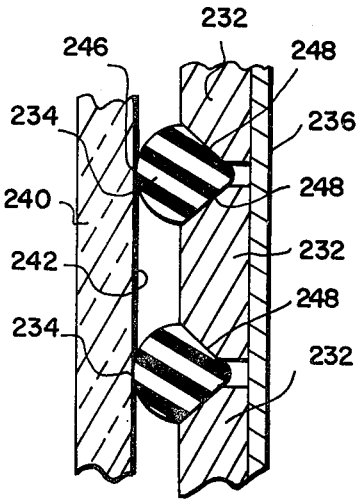
FIG. 10 is an enlarged fragmentary sectional view taken on the same plane as that of FIG. 9 but showing the seal structure on an enlarged scale.

Fixed to the cap 70 is a hollow tubular member 235 having a flared annular flange 238 which engages one of the O-rings 234 while the flange 230 of the nut 228 engages one of the annular wedge members 232 as shown in FIG. 2 of the drawings whereby the nut 228 when screw threadably extended toward the end of the bottle neck 240 causes the annular wedges 232 to squeeze the O-rings 234 and expand them into intimate frictional and compressive relation with the bore of the bottle neck as will be hereinafter described in detail in connection with FIGS. 9 and 10 of the drawings.

The bottle neck 240 as shown in FIG. 10 of the drawings is provided with a bore 242 engaged by a peripheral portions 246 of the O-rings 234 and the annular wedges 232 are provided with opposed angular ends 248 which compress respective O-rings outward with the bore 242 of the bottle neck 240. It will be seen that the annular wedge members 232 at their adjacent ends provide a substantially V-shaped slot which is squeezed together compressing the O-rings 234 when the nut 228 is screw threadably advanced on the cap 270 in a direction toward the bottle neck 240.

Figure 8:
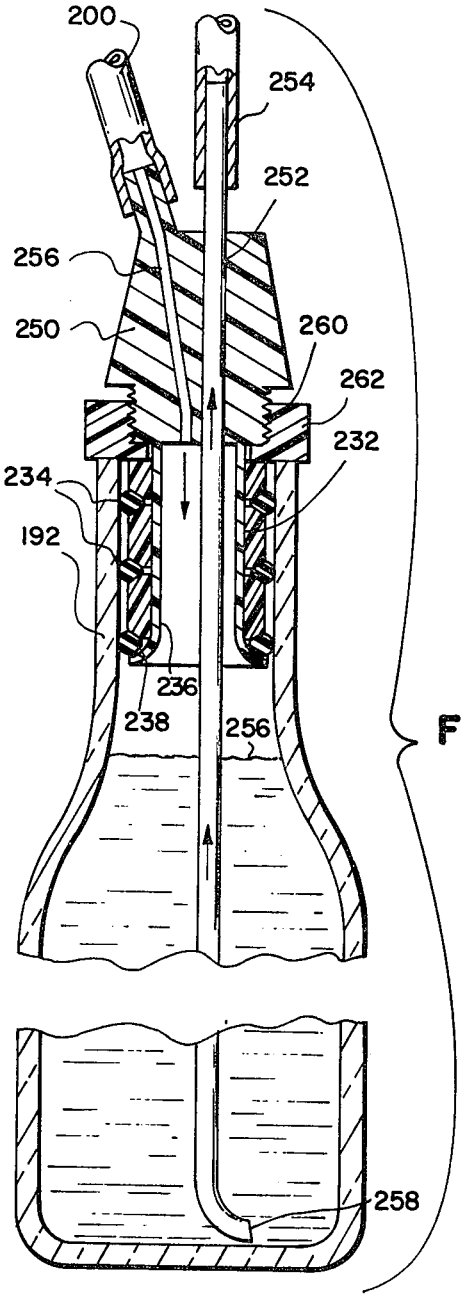
FIG. 8 is an axial sectional view of one of the liquor bottles shown in FIG. 7 and showing fragmentarily tubular connections thereto through the cap thereof.

It will be seen that caps 250 are shown in FIGS. 7 and 8 and these caps are used for the bottles 186, 188, 190 and 192.

Each cap is similar to that hereinbefore descrbied except that the caps 250 are provided with a liquor outlet passage 252 coupled to a respective outlet tube 254, the passage 252 having a dip tube 256 extending at its lower open end 258 to the lower portion of the bottle 192 so that liquor may be forced out through the tube 256 to respective one of the valves 178, 180, 182, 184 is accordance with the connection thereof with the respective bottle. The cap 250 is also provided with a compressed fluid inlet passage 256 communicating with a respective tube 194, 196 198 or 200 depending upon which of the bottles 186, 188, 190 or 192 is being pressurized for dispensation of liquor therefrom.

The cap 250 shown in FIG. 8 is provided with an externally screw threaded portion 260 on which a nut 262 is externally screw threaded and this nut bears against the hereinbefore described annular O-ring wedge members 232 for compressing the respective O-rings 234 as hereinbefore described in connection with FIG. 2 of the drawings.

In the modification as shown in FIG. 9 of the drawings, a closed cap 264 is provided with an externally screw threaded portion 268 engaged by a nut 270 similar to the nut 228 and the 262. This nut exerts pressure on the annular O-rings 232 for compressively extending the O-rings 234 into intimate engagement with the bore 242 of the bottle neck 240.

The cap structure shown in FIG. 9 of the drawings may be used for enclosing beverage bottles from which only part of the contents have been used and may be very beneficial in preserving carbonation in soft drinks or the like which are stored in the refrigerator after part of the contents of the bottle has been dispensed therefrom It will be obvious to those skilled in the art that various modifications of the present invention may be resorted to without departing from the spirit of the invention.

I claim:

1. In a liquor dispenser the combination of: an electromagnetic means; said electromagnetic means comprising a generally ring-shaped electromagnetic coil having a central opening therein; a bottle cap and spout means adapted to be secured to the neck of a liquor bottle or the like; said bottle cap and spout means having a dispenser spout provided with an outlet passage therein; a magnetically responsive valve in said spout means; a spout holder adjacent to said electromagnetic means and adapted to receive said spout in a position centrally of said ring-shaped electromagnetic means; conduit means for conducting compressed pneumatic fluid into said spout holder; a source of compressed pneumatic fluid communicating with said conduit means; second means on said bottle cap and spout means adapted to be pneumatically and sealingly coupled to said conduit means when said spout is inserted in said holder; said second means disposed to conduct pneumatic fluid under pressure into a bottle with which said cap is connected for forcing liquid outwardly through said magnetically responsive valve; said spout holder comprising guide means in adjacent relation to said electromagnetic means for engaging said spout and for pneumatically coupling said second means; switch means disposed and adapted to energize said electromagnetic means; and magnetic valve means coupled to said conduit and in circuit with said switch means and energizeable thereby; said magnetic valve means adapted to admit said compressed pneumatic fluid into said conduit means and through said second means into said bottle for forcing liquid outwardly through said outlet passage and said magnetically responsive valve when opened by said electromagnetic means.

2. The invention as defined in claim 1, wherein: said source of compressed pneumatic fluid communicates with said magnetic valve means; and a pressure regulator for regulating the pressure of said pneumatic fluid to said conduit means.

3. In a liquor dispenser the combination of: an electromagnetic means; said electromagnetic means comprising a generally ring-shaped electromagnetic coil having a central opening therein; a bottle cap and spout means adapted to be secured to the neck of a liquor bottle or the like; said bottle cap and spout means having a dispenser spout provided with a magnetically responsive valve therein; a spout holder adjacent to said electromagnet means and adapted to receive said spout in a position centrally of said ring-shaped electromagnetic means; conduit means for conducting pneumatic fluid under pressure into said spout holder; second means on said bottle cap and spout means adapted to be pneumatically and sealingly coupled to said conduit means when said spout is inserted in said holder; said second means disposed to conduct pneumatic fluid under pressure into a bottle with which said cap is connected for forcing liquid outwardly through said magnetically responsive valve; said spout holder comprising guide means in adjacent relation to said electromagnetic means for engaging said spout and for pneumatically coupling said second means and said conduit means; switch means disposed and adapted to energize said electromagnetic means; and magnetic valve means coupled to said conduit and in circuit with said switch means and energizable thereby; said magnetic valve means adapted to admit pneumatic fluid under pressure into said conduct means and through said second means into said bottle for forcing liquid outward through said magnetically responsive valve when opened by said electromagnetic means; a time delay relay is in circuit with said switch and said electromagnetic means and said magnetic valve means whereby said switch energizes said time delay relay and said magnetic valve means first to allow pneumatic pressure to build up in said bottle and whereby said time delay relay subsequently energizes said electromagentic means for operating said magnetically responsive valve in said cap and spout means after a predetermined pressure has been built up in said bottle.

4. The invention as defined in claim 3, wherein: said cap and spout means is provided with a liquid flow control passage adapted to cooperate with pneumatic pressure in said bottle for dispensing a given amount of liquor in a predetermined period of time.

5. The invention as defined in claim 4, wherein: a timer is in circuit with said electromagnetic means and said switch, said timer thus adapted to de-energize said magnetically responsive valve after it has been open for a predetermined period of time.

6. The invention as defined in claim 3, wherein: said magnetic valve means a three way valve whereby the de-energization thereof allows pneumatic fluid pressure to be exhausted from said conduit means and the interior of said bottle.

7. The invention as defined in claim 3, wherein: a pour volume control switch is in circuit with said time delay relay and wherein a second delay relay is in circuit with said first mentioned time delay relay and said second time delay is adapted to maintain said electromagnetic means and said magnetic valve means energized for a substantially greater period of time for attaining a longer pour such as a double shot or the like; and a counter in circuit with said time delay relays for counting successive operations of said first mentioned switch for counting the aggregates of successive dispensations of liquor.

8. The invention as defined in claim 3, wherein: a counter is disposed in circuit with said electromagnetic means for counting and recording each dispensation of fluid from said bottle and through said magnetically responsive valve.

9. In a liquor dispenser the combination of: an electromagnetic means; said electromagnetic means comprising a generally ring-shaped electromagnetic coil having a central opening therein; a bottle cap and spout means adapted to be secured to the neck of a liquor bottle or the like; said bottle cap and spout means having a dispenser spout provided with a magnetically responsive valve therein; a spout holder adjacent to said electromagnetic means and adapted to receive said spout in a position centrally of said ring-shaped electromagnetic means; conduit means for conducting pneumatic fluid under pressure into said spout holder, second means on said bottle cap and spout means adapted to be pneumatically and sealingly coupled to said conduit means when said spout is inserted in said holder; said second means disposed to conduct pneumatic fluid under pressure into a bottle with which said cap is connected for forcing liquid outwardly through said magnetically responsive valve; said spout holder comprising guide means in adjacent relation to said electromagnetic means for engaging said spout and for pneumatically coupling said second means; switch means disposed and adapted to energize said electromagnetic means; and magnetic valve means coupled to said conduit and in circuit with said switch means and energizable thereby; said magnetic valve means adapted to admit pneumatic fluid under pressure into said conduct means and through said second means into said bottle for forcing liquid outward through said magnetically responsive valve when opened by said electromagnetic means; a movable support carries said electromagnetic means and said guide means; said cap and spout having a gasket means engagable with said guide means for making a seal relative to said couduit means and tending to stop movement of said movable support whereby force of a bottle against said guide means causes said gasket means to seal.

10. The invention as defined in claim 9, wherein: said switch is operable by said movable support when pressure of said spring is overcome allowing said movable support to travel a short distance.

11. The invention as defined in claim 10, wherein: said cap and spout are provided with a generally conical converging portion; said gaskets being in spaced relation axially of said converging portion; a passage between said gaskets extending through said cap into said bottle;

12. The invention as defined in claim 11, wherein: said movable support is movably operable to actuate said first mentioned switch; and stop means adapted to limit the movement of said movable support within a short distance after said switch is actuated.

13. In a liquor dispenser the combination of: an electromagnetic means; said electromagnetic means comprising a generally ring-shaped electromagnetic means comprising a generally ring-shaped electromagnetic coil having a central opening therein; a bottle cap and spout means adapted to be secured to the neck of a liquor bottle or the like; said bottle cap and spout means having a dispenser spout provided with a magnetically responsive valve therein; a spout holder adjacent to said electromagnetic means and adapted to receive said spout in a position centrally of said ring-shaped electromagnetic means; conduit means for conducting pneumatic fluid under pressure into said spout holder; second means on said bottle cap and spout means adapted to be pneumatically and sealingly coupled to said conduit means when said spout is inserted in said holder; said second means disposed to conduct pneumatic fluid under pessure into a bottle with which said cap is connected for forcing liquid outwardly through said magnetically responsive valve; said spout holder comprising guide means in adjacent relation to said electromagnetic means for engaging said spout and for pneumatically coupling said second means and said conduit means; switch means disposed and adapted to energize said electromagnetic means; and magnetic valve means coupled to said conduit and in circuit with said switch means and energizable thereby; said magnetic valve means adapted to admit pneumatic fluid under pressure into said conduit means and through said second means into said bottle for forcing liquid outward through said magnetically responsive valve when opened by said electromagnetic means; a normally open switch is operable by insertion of said spout into said guide means; said normally open switch in circuit with said first mentioned switch whereby said first mentioned switch is de-energized when said spout is not in said guide means; a plurality of selector switches mounted in adjacent relationship to said guide means; a plurality of respective liquor containers; a plurality of respective solenoid valves communicating with said containers; fluid pressure conducting tubes; a source of fluid under pressure communicating with said tubes; a plurality of timers coupled to said last mentioned solenoid valves; said solenoid valves having outlet tubes extending into proximity of said guide means for dispensing liquor in a direction comparable to that from said spout when said magnetically responsive valve is actuated whereby operation of any one of said selector switches energizes one of said last mentioned timers for controlling one of said last mentioned solenoid valves for dispensing liquor under pressure from one of said plurality of containers.

14. In a liquor dispenser the combination of: an electromagnetic means; said electromagnetic means comprising a generally ring-shaped electromagnetic coil having a central opening therein; a bottle cap and spout means adapted to be secured to the neck of a liquor bottle or the like; said bottle cap and spout means having a dispenser spout provided with a magnetically responsive valve therein; a spout holder adjacent to said electromagnetic means and adapted to receive said spout in a position centrally of said ring-shapd electromagnetic means; conduit means for conducting pneumatic fluid under pressure into said spout holder; second means on said bottle cap and spout means adapted to be pneumatically and sealingly coupled to said conduit means when said spout is inserted in said holder; said second means disposed to conduct pneumatic fluid under pressure into a bottle with which said cap is connected forcing liquid outwardly through said magnetically responsive valve; said spout holder comprising guide means in adjacent relation to said electromagnetic means for engaging said spout and for pneumatically coupling said second means and said conduit means; switch means disposed and adapted to energize said electromagnetic means; and magnetic valve means coupled to said conduit and in circuit with said switch means and energizable thereby; said magnetic valve means adaped to admit pneumatic fluid under pressure into said conduit means and through said second means into said bottle for forcing liquid outward through said magnetically responsive valve when opened by said electromagnetic means; a swing arm is pivotally mounted on a generally horizontal axis, said electromagnetic means and and said guide means carried by said swing arm; said switch means operable by movement of said swing arm; resilient means tending to resist movement of said swign arm; said switch operable by movement of said swing arm when said spout is inserted in said spout holder and guide means for the dispensation of liquor from said bottle.

15. A cap and spout for a liquor bottle or the like; said cap and spout having a body portion provided with means for sealingly engaging a neck of a liquor bottle or the like; said body portion having a converging annular shoulder portion; a reduced cylindrical annular in cross section spout portion extending beyond said shoulder portion; said spout portion being a hollow cylindrical structure having a bore therein; a magnetically responsive valve member disposed in said bore; a valve seat in said body portion; a spring in said spout portion forcing said valve member to close against said seat portion; a pair of annular compressible gaskets on said converging shoulder portion; and passage means communicating between said gaskets and extending to the portion of said body which communicates with the interior of a bottle; an air conducting tube communicating with said passage means and adapted to extend to the normally lower end of a bottle; and passage means communicating with said valve seat and extending through said body and adapted to communicate with the interior of a bottle in which said cap is secured.

16. The invention as defined in claim 15, wherein: an electromagnetic means is provided with a generally ring-shaped coil provided with a central opening therein; guide means coupled to said electromagnetic means and having a converging bore portion adapted to receive said shoulder of said cap and adapted to be engaged by said annular gaskets; a conduit means communicating with said guide means and extending between the area of said gaskets when engaged with said converging bore portion; said ring-shaped electromagnetic means having a central opening adapted to receive said spout whereby said magnetically responsive valve member may be energized by said electromagnetic means and thereby move said valve member from said seat and allow liquid to flow under pressure through said magnetically responsive valve and outwardly centrally through a central area of said electromagnetic means. said conduit extending through said guide means and into communication between said gaskets; said guide means having a converging annular portion in which said gaskets are compressably engaged; said conduit communicating through said guide means at a location between said gaskets when they are engaged in said converging portion of said guide means.

* * * * *